US006063261A

United States Patent [19]

Baca

[11] Patent Number: 6,063,261

[45] **Date of Patent: *May 16, 2000**

[54] CONDITIONING OIL FOR BOWLING LANES

[75] Inventor: Joseph Samuel Baca, Stockton, Calif.

[73] Assignee: Lane Masters, Inc., Stockton, Calif.

[ * ] Notice: This patent is subject to a terminal disclaimer.

[21] Appl. No.: 08/835,940

[22] Filed: Apr. 11, 1997

[51] Int. Cl.[7] ..... C10G 71/00

[52] U.S. Cl. ..... 208/18; 208/19; 508/371; 508/206; 508/202; 508/583; 508/364

[58] Field of Search ..... 208/18, 19; 508/371, 508/206, 202, 583, 364

[56] References Cited

U.S. PATENT DOCUMENTS

| | | | |
|---|---|---|---|
| 3,589,923 | 6/1971 | Stein | 106/285 |
| 3,932,043 | 1/1976 | Joffre | 401/137 |
| 4,478,730 | 10/1984 | O'Connor | 252/34.7 |
| 5,534,173 | 7/1996 | Faber et al. | 508/203 |
| 5,883,055 | 3/1999 | Baca | 508/202 |

*Primary Examiner*—Walter D. Griffin
*Assistant Examiner*—Nadine Preisch
*Attorney, Agent, or Firm*—Flehr Hohbach, Test Albritton & Herbert LLP

[57] ABSTRACT

Conditioning oil for use on bowling lanes. The oil contains a mixture of mineral oil, a leveling agent, and an antistatic agent. The mineral oil is a combination of paraffin and petroleum based mineral oils, and in some embodiments, the mixture also includes isopropyl alcohol, a fluorescent whitening agent, and a lubricity agent.

31 Claims, No Drawings

CONDITIONING OIL FOR BOWLING LANES

BACKGROUND OF THE INVENTION

1. Field of the Invention

This invention pertains generally to the preparation and care of bowling lanes and, more particularly, to a conditioning oil for use on bowling lanes.

2. Related Art

Conditioning oil is applied to the surface of bowling lanes to provide proper ball action. The oil is applied to the head and center portions of each lane so that the ball will slide over them and then grip the surface as it approaches the pin deck.

The oil has a significant effect on the manner in which the ball travels down the lane, and proper oiling is very important for consistent action and scoring. If the oil gets picked up by the ball and carried down the lane or is pushed down the lane ahead of the ball, the oil can get onto the pin deck where it can cause the pins to slide around instead of falling. If the oil gets into the ball return machine, and it can gum the machine it up and interfere with its operation.

With too little oil, the ball does not slide far enough before taking hold of the lane, which results in too much hook or hooking or in an unpredictable and uncontrollable manner.

In addition, channels can form in the oil where the balls have travelled, causing uneven oiling and further inconsistencies in the manner in which the balls behave on the lane.

OBJECTS AND SUMMARY OF THE INVENTION

It is in general an object of the invention to provide a new and improved conditioning oil for use on bowling lanes.

Another object of the invention is to provide a conditioning oil of the above character which substantially eliminates the problems associated with the lane oils of the prior art.

These and other objects are achieved in accordance with the invention by providing a lane conditioning oil which contains a mixture of mineral oil, a leveling agent, and an antistatic agent. The mineral oil is a combination of paraffin and petroleum based mineral oils, and in some embodiments, the mixture also includes isopropyl alcohol, a fluorescent whitening agent, and a lubricity agent.

DETAILED DESCRIPTION

Approximately 75 to 85 percent of the oil mixture is a high grade paraffin mineral oil which is crystal clear in appearance and serves as the base for the mixture. The paraffin oil is refined to eliminate long carbon chains and preferably has no more than about 20 to 30 carbon atoms per molecule.

A petroleum based mineral oil is combined with the paraffin oil and constitutes about 10 to 20 percent of the mixture. The petroleum based oil has a higher viscosity than the paraffin based oil and tends to adhere to the lanes somewhat better than the lighter paraffin oil. That is an important characteristic in preventing the oil from carrying down the lane with the ball.

The heavier oil also provides better ball control and better ball action on the portion of the lane to which the oil is applied.

For greater quantities of oil and stronger oil ratio patterns (i.e., top hat condition), lower viscosity oils can be employed. For lower amounts of lane dressing and weaker oil pattern ratios, higher viscosities are used.

With some of the machines which are used for applying the oil to the lanes, it is desirable to include isopropyl alcohol in the mixture. Such machines have a wick of felt material which carries the oil from a trough to the roller which applies it to the lanes. The alcohol thins the oil so that it is better able to travel up the wick and onto the roller. Once the oil has been applied to the lanes, the alcohol evaporates or "flashes off" and does not affect the performance of the oil. Newer felt materials provide a better wicking action and may be able to carry the oil without the alcohol, in which case the alcohol can be eliminated from the mixture. The amount of isopropyl alcohol which is used is on the order of 0 to about 8 percent (by volume) of the mixture.

A fluorescent whitening agent is included in the mixture in order to meet the requirements of the American Bowling Congress. That agent enables lane men to check the thickness of the oil which has been applied to the lanes and to insure that it is within prescribed standards. The whitening agent constitutes about 0.03 percent (by volume) of the mixture.

In some applications, a lubricity agent composed of various hydrocarbon lubrication oils is included in the mixture to help the ball hold the lane better and to react better. In many applications, the lubricity agent is not required, in which case it can be omitted from the mixture. When included, the lubricity agent constitutes about 0.1 to 2.0 percent of the mixture.

A leveling agent is included in the mixture so that the oil on the lane will close behind the ball and remain level, rather than forming channels which could affect the action of subsequent balls. If the oil did not flow back, balls would begin hooking where they used to slide, and the ball action would be inconsistent. The leveling agent comprises on the order of about 0.1 to 2.0 percent (by volume) of the mixture. If too much leveling agent is used, the oil will tend to build up and splatter in front of the ball, thereby producing an undesirable effect of carrying the oil down the bowling lane.

An antistatic agent is included in the mixture to prevent static buildup which can cause oil and dirt to adhere to the ball. The static tends to develop as the ball, which is typically made of a resin based material, travels over the oil and wood interface at the surface of the lane. The oil which adheres to the ball is carried down the lane, dust particles in the air are attracted to the ball, and the ball action becomes sluggish. By including the antistatic agent in the mixture, these problems are eliminated. The antistatic agent comprises about 0.1 to 2.0 percent (by volume) of the mixture.

EXAMPLE

A 500 gallon batch of the conditioning oil made in accordance with a presently preferred formulation contains the following mixture of ingredients:

- Paraffin mineral oil (402.77 gals)
- Petroleum mineral oil (61.96 gals)
- Isopropyl alcohol (30.98 gals)
- Fluorescent whitening agent (0.14 gal)
- Lubricity agents
  - Solvent dewaxed heavy paraffinic petroleum distillate (0.97 gal)
  - Hydrotreated heavy napthenic petroleum distillate (0.31 gal)
  - Calcium alkaryl sulfonate (0.03 gal)
  - Amine grafted ethylene/propylene copolymer (0.04 gal)
  - Zinc Dithiopthsphate (0.03 gal)

Leveling agent
Akylsiloxane (1.3 gals)
Antistatic Agents
Chloro-propyl-trimethoxy-silane (0.69 gal)
Methyl alcohol (0.69 gal)

All components are blended together thoroughly, e.g. by high speed agitation or in-line blending for a minimum of 45 minutes. Thorough blending is important for product uniformity and performance consistency.

The invention has a number of important features and advantages. It provides consistent ball action and scoring, which are critical to good bowling. The ball slides down the lane without developing channels and without carrying the oil with it. Static buildup is eliminated, and there is no tendency for dirt and oil to adhere to the ball. This results not only in more consistent bowling but also in a significant increase in the cleanliness of the lanes. In addition, since the oil remains in place better than other oils, the time between oilings is reduced, and that has the additional advantages of reducing not only the cost of the materials and labor involved but also the time the lanes are out of service during conditioning.

It is apparent from the foregoing that a new and improved conditioning oil for use on bowling lanes has been provided. While only certain presently preferred embodiments have been described in detail, as will be apparent to those familiar with the art, certain changes and modifications can be made without departing from the scope of the invention as defined by the following claims.

I claim:

1. A conditioning oil for use on bowling lanes, comprising a mixture of about 85–105 parts oil, 0.1–2.0 parts leveling agent, and 0.1–2.0 parts antistatic agent.

2. The conditioning oil of claim 1 wherein the oil includes a paraffin based mineral oil and a petroleum based mineral oil.

3. The conditioning oil of claim 2 wherein the mixture comprises about 75–85 parts paraffin based mineral oil, 10–20 parts petroleum based mineral oil, 0.1–2.0 parts leveling agent, and 0.1–2.0 parts antistatic agent.

4. The conditioning oil of claim 1 wherein the mixture further includes a thinning agent.

5. The conditioning oil of claim 4 wherein the mixture comprises about 85–105 parts mineral oil, 0–8 parts isopropyl alcohol, 0.1–2.0 parts leveling agent, and 0.1–2.0 parts antistatic agent.

6. A conditioning oil for use on bowling lanes, comprising a mixture of oil, a leveling agent, an antistatic agent, and a fluorescent whitening agent.

7. The conditioning oil of claim 6 wherein the whitening agent is present in an amount on the order of 0.03 percent by volume of the mixture.

8. A conditioning oil for use on bowling lanes, comprising a mixture of oil, a leveling agent, an antistatic agent, and a lubricity agent.

9. The conditioning oil of claim 8 wherein the lubricity agent is present in an amount on the order of 0.1–2.0 percent by volume of the mixture.

10. The conditioning oil of claim 8 wherein the lubricity agent contains a solvent dewaxed heavy paraffinic petroleum distillate, a hydrotreated heavy napthenic petroleum distillate, a calcium alkaryl sulfonate, an amine grafted ethylene/propylene copolymer, and zinc dithiopthsphate.

11. A conditioning oil for use on bowling lanes, comprising a mixture of oil, a leveling agent, and an antistatic agent which contains chloro-propyl-trimethoxy-silane and methyl alcohol.

12. A conditioning oil for use on bowling lanes consisting essentially of 75–85 parts paraffin based mineral oil, 10–20 parts petroleum based mineral oil, 0–8 parts thinning agent, 0.03 part fluorescent whitening agent, 0.1–2.0 parts lubricity agent, 0.1–2.0 parts leveling agent, and 0.1–2.0 parts antistatic agent.

13. A conditioning oil for use on bowling lanes consisting essentially of 75–85 parts paraffin based mineral oil, 10–20 parts petroleum based mineral oil, 0.1–2.0 parts leveling agent, and 0.1–2.0 parts antistatic agent.

14. The coditioning oil of claim 13 further including 0–8 parts thinning agent.

15. The conditioning oil of claim 13 further including 0.03 part fluorescent whitening agent.

16. The conditioning oil of claim 13 further including 0.1–2.0 parts lubricity agent.

17. The conditioning oil of claim 16 wherein the lubricity agent contains a solvent dewaxed heavy paraffinic petroleum distillate, a hydrotreated heavy napthenic petroleum distillate, a calcium alkaryl sulfonate, an amine grafted ethylene/propylene copolymer, and zinc dithiopthsphate.

18. The conditioning oil of claim 13 wherein the antistatic agent contains on the order of 50 percent chloro-propyl-trimethoxy-silane and 50 percent methyl alcohol.

19. The conditioning oil of claim 4 wherein the thinning agent is isopropyl alcohol.

20. The conditioning oil of claim 12 wherein the thinning agent is isopropyl alcohol.

21. The conditioning oil of claim 14 wherein the thinning agent is isopropyl alcohol.

22. A conditioner for use on bowling lanes, comprising a mixture of about 85–105 parts oil, 0.1–2.0 parts leveling agent, and 0.1–2.0 parts antistatic agent.

23. The conditioner of claim 22 wherein the oil is a mineral oil.

24. The conditioner of claim 22 wherein the oil includes a paraffin based mineral oil and a petroleum based mineral oil.

25. The conditioner of claim 22 wherein the mixture further includes a thinning agent.

26. The conditioner of claim 22 wherein the mixture further includes a lubricity agent.

27. The conditioning oil of claim 1 wherein the oil is a mineral oil.

28. The conditioning oil of claim 6 wherein the oil is a mineral oil.

29. The conditioning oil of claim 6 wherein the oil includes a paraffin based mineral oil and a petroleum based mineral oil.

30. The conditioning oil of claim 8 wherein the oil is a mineral oil.

31. The conditioning oil of claim 8 wherein the oil includes a paraffin based mineral oil and a petroleum based mineral oil.

* * * * *